United States Patent [19]

Dziuk

[11] 4,150,806

[45] Apr. 24, 1979

[54] VEHICLE RETAINER FOR THERMOS BOTTLES

[76] Inventor: Vincent B. Dziuk, 8224 - 89th Ave. North, Brooklyn Park, Minn. 55445

[21] Appl. No.: 857,787

[22] Filed: Dec. 5, 1977

[51] Int. Cl.[2] ..... A47G 23/02

[52] U.S. Cl. ..... 248/154; 248/105; 248/311.3

[58] Field of Search ..... 248/103, 104, 105, 106, 248/107, 154, 311.3

[56] References Cited

U.S. PATENT DOCUMENTS

| | | | |
|---|---|---|---|
| 816,105 | 3/1906 | Lewis | 248/107 |
| 827,559 | 7/1906 | Oberg | 248/107 |
| 1,276,936 | 8/1918 | McGee | 248/105 |
| 1,820,420 | 8/1931 | Aerick | 248/103 |
| 1,829,353 | 10/1931 | Hogan | 248/105 |
| 1,867,969 | 7/1932 | Fiegel | 248/107 |
| 2,391,264 | 12/1945 | Nickelson | 248/103 |

FOREIGN PATENT DOCUMENTS

| | | | |
|---|---|---|---|
| 309872 | 12/1955 | Switzerland | 248/107 |

*Primary Examiner*—Robert A. Hafer

*Attorney, Agent, or Firm*—Orrin M. Haugen; Thomas J. Nikolai

[57] ABSTRACT

A device for releasably retaining a liquid dispensing vacuum bottle in a desired position within the passenger compartment of a vehicle so as to be readily accessible to an occupant thereof. The device includes a base member adapted to be secured to the vehicle's seat and mounted on the base is a cradle assembly into which a vacuum bottle may be placed and releasably clamped. The cradle assembly is designed to afford a predetermined inclination to a vacuum bottle disposed therein to facilitate the dispensing of a liquid therefrom.

1 Claim, 5 Drawing Figures

VEHICLE RETAINER FOR THERMOS BOTTLES

BACKGROUND OF THE INVENTION

I. Field of the Invention

This invention relates generally to a motor vehicle accessory, and more specifically to a holder for thermos bottles, and the like, when carried in a motor vehicle.

II. Description of the Prior Art

A variety of devices have been devised and patented for retaining a vacuum bottle in a desired orientation within the passenger compartment of a motor vehicle. For example, reference is made to the Kuddie U.S. Pat. No. 2,926,828 which describes a fixture adapted to be attached to the underside of a vehicle dashboard, the fixture providing a compartment into which a thermos bottle may be inserted. In a similar fashion, the Gottsegen et al U.S. Pat. No. 2,645,392 describes a container for thermos bottles having U-shaped brackets adapted to be clamped over the edge of a vehicle seat. The Scioloro U.S. Pat. No. 3,050,223 and the Trachtenberg et al U.S. Pat. No. 3,508,732 further describe various brackets or clamping arrangements for holding a vacuum bottle in a desired orientation. It is to be noted that in each of the aforementioned arrangements the vacuum bottle is held in a position which precludes the ready dispensing of the liquid contained within the thermos bottle. In each instance, the operator must first remove the vacuum bottle from its fixture, open its cover, uncork the bottle and then pour the liquid into a drinking cup. The steps must then be reversed in returning the bottle to its fixture. It is quite apparent that this can be a difficult maneuver for the driver of a motor vehicle, especially when navigating through heavy traffic.

The Shaw U.S. Pat. No. 2,915,082 discloses a bracket and clamping arrangement for a thermos bottle which is adapted to be secured to the underside of the vehicle's dashboard. This patent further suggests the idea of having a spigot mounted on the vacuum bottle so that its contents may be emptied into a cup without removing the vacuum bottle from its holder assembly. While the device of the Shaw Patent allows the driver or passenger to serve himself from the vacuum bottle while it remains in its stowed position, it requires rather difficult mounting procedures in that numerous holes must be drilled into the vehicle's dashboard and fire wall in order to secure the vacuum bottle retaining device in position.

SUMMARY OF THE INVENTION

In accordance with the teachings of the present invention, all of the problems with the aforementioned prior art arrangements are obviated. The thermos bottle retainer of the present invention may be easily mounted and retained on the seat of the motor vehicle in a location which is readily accessible to the driver and front seat passenger alike. In the construction of my invention, I provide a base member which is adapted to rest on the horizontal seat portion of the vehicle and which includes plural, upwardly extending support legs. Connected between the upper ends of the support legs is a cradle assembly which is curved to generally conform with the outer periphery of a thermos bottle. This cradle is arranged such that the thermos bottle will be inclined slightly towards its pouring spout when the fixture is secured in position. A flexible strap is coupled at one end to the base and passes around the vacuum bottle and means are provided for securing the free end of the strap to the base member such that the bottle will be retained in its cradle even when traversing the roughest of terrain. Because of the simplicity of construction, the fixture of the present invention is economical to manufacture and can therefore be sold at a competitive price and, because of its rugged construction, should last a relatively long time without servicing of any type.

OBJECTS

It is accordingly a principal object of this invention to provide a vacuum bottle retainer assembly for vehicles which will permit either the driver or passengers to safely and conveniently serve beverages within the vehicle.

Another object is to provide a unique cradle assembly into which a beverage container may be held and which may be secured to the front seat of the vehicle within easy reach of the driver or a passenger.

Still another object of the invention is to provide an extremely economical and yet highly effective vacuum bottle retainer for use in motor vehicles.

For further comprehension of the invention and of the objects and advantages thereof, reference will be had to the following description and accompanying drawings and to the appended claims in which the various novel features of the invention are more particularly set forth.

DESCRIPTION OF THE DRAWINGS

Referring to the drawings, in which the same characters of reference are employed to indicate corresponding or similar parts throughout the several figures of the drawings.

DESCRIPTION OF THE PREFERRED EMBODIMENT

Figure 1:
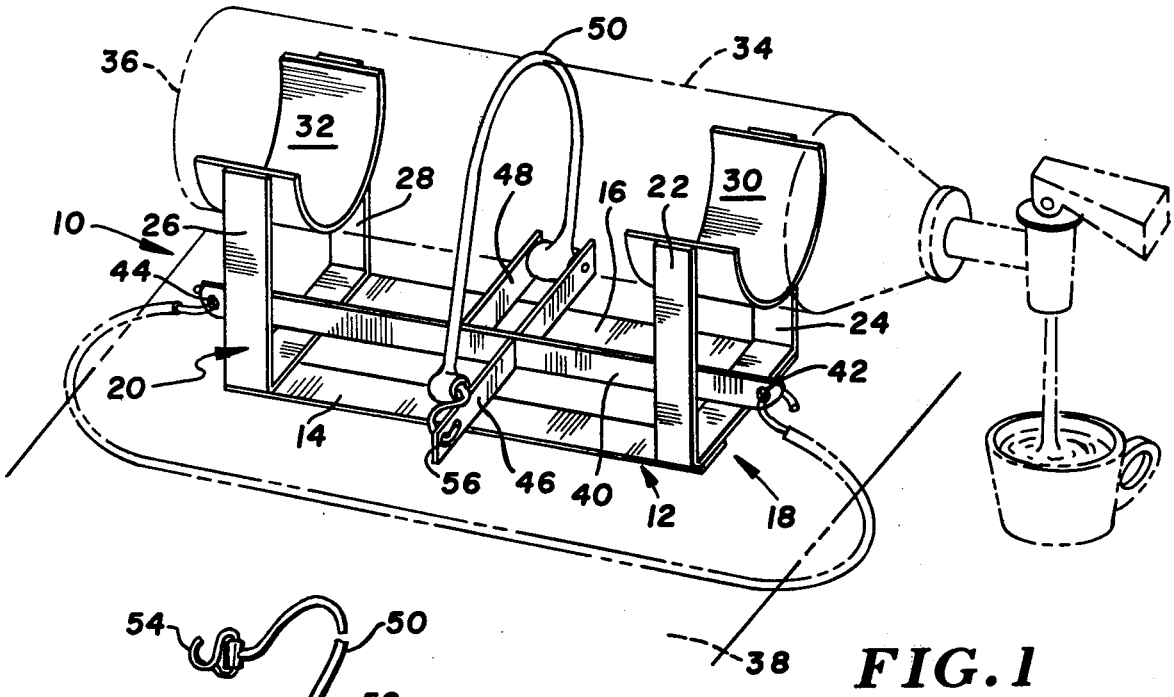
FIG. 1 is a perspective view of the vacuum bottle retainer showing the vacuum bottle in phantom line representation.

With reference to FIG. 1, it can be seen that the vacuum bottle holding fixture, indicated generally by numeral 10, comprises a base member 12 which includes first and second, generally coplanar, spaced apart strip elements 14 and 16. First and second "U"-shaped brackets 18 and 20 are fastened between the elongated strips 14 and 16 proximate the end portions thereof to form a generally rectangular surface. The brackets 18 and 20 include integrally formed, spaced apart legs 22–24 and 26–28, respectively. The lengths of the legs 26 and 28 of the "U"-shaped bracket 20 are somewhat longer than the corresponding legs 22 and 24 of the bracket 18.

Connected between the legs 22 and 24 of the bracket 18 is a first cradle member 30, the attachment being proximate to the end portion of the upwardly projecting legs. Similarly, a cradle member 32 is coupled between the upper ends of the legs 26 and 28. These cradle members are shaped to generally conform to the outer periphery of a vacuum or thermos bottle which is shown in phantom line representation and identified by the numeral 34. Because the legs 22 and 24 are somewhat shorter than the legs 26 and 28 of the respective support members 18 and 20, when a vacuum bottle 34 is positioned within the cradle member, the vacuum bottle will be inclined by a predetermined angle with the spigot end thereof being lower than the closed bottom end 36 when the base member 12 is resting against a generally horizontal surface such as the vehicle seat 38. Thus, the liquid contained within the thermos bottle will tend to flow towards the spigot end which facilitates the complete draining thereof.

Extending between the base portion of the brackets 18 and 20 and extending outwardly beyond them is a first median rib member 40 which has apertures 42 and 44 formed therethrough in proximity to the extending ends. In order to secure the assembly to the vehicle seat 38 an elongated bungee cord is hooked at one end through the aperture 42, passed under the seat and wrapped around to engage the other aperture 44.

Figure 2:
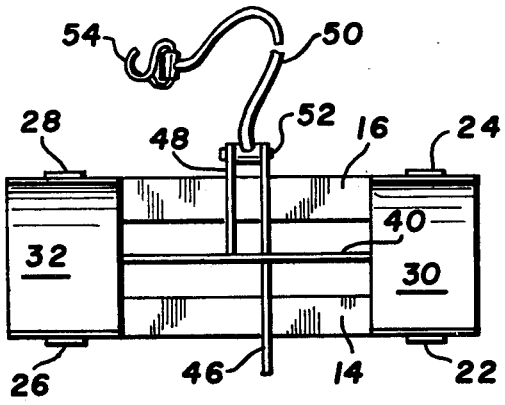
FIG. 2 is a top plan view of the vacuum bottle retainer device.
Figure 3:
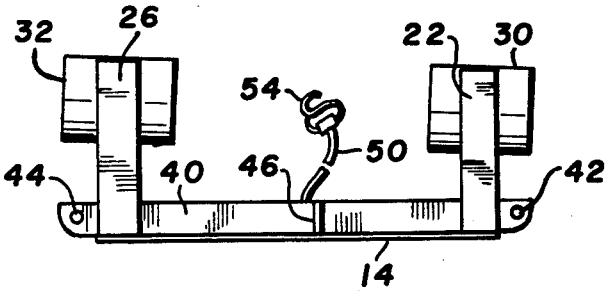
FIG. 3 is a side elevation of the device of FIG. 2.
Figure 4:
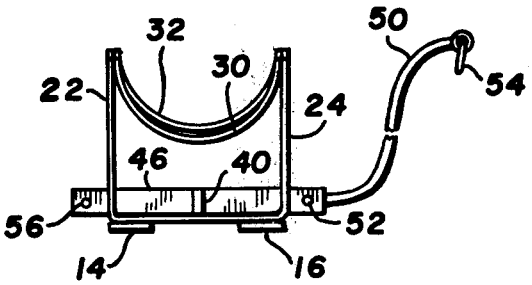
FIG. 4 is an end view of the preferred embodiment.
Figure 5:
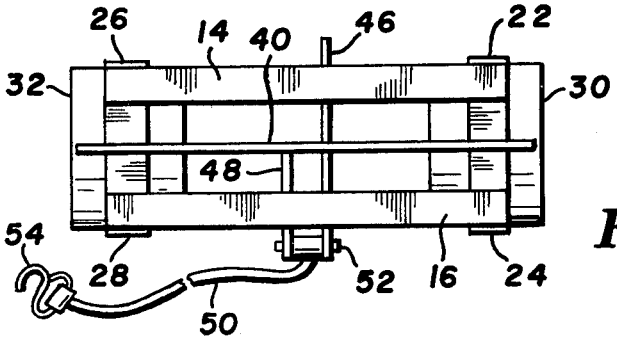
FIG. 5 is a bottom plan view of the preferred embodiment.

An additional cross member 46 extends between the base strips 14 and 16 and is welded or otherwise attached thereto at points approximately midway between the brackets 18 and 20. The cross piece 46 intersects the rib 40 and is welded or adhesively attached thereto, depending upon the choice of materials used for the structural elements utilized. A second cross member 48 is attached between the strip 16 and the median rib member 40 and is generally parallel to the cross member 46. A flexible strap 50 is secured at one end thereof between the parallel strips 46 and 48 by means of a pin 52, as best illustrated in FIG. 2. As is illustrated in FIG. 1, this strap is adapted to pass around the outer periphery of a vacuum bottle when it is in its position within the cradles 30 and 32. The free end of the strap 50 has a hook 54 which is adapted to pass through an aperture 56 formed in the end of the cross strut 46. The strap 50 is preferably formed from rubber or another suitable elastic material so as to securely hold the vacuum bottle within the confines of the cradle.

While there has been shown and described a preferred embodiment of the invention and the best mode presently contemplated by me for carrying out the invention, it should be apparent to those skilled in the art that various modifications and changes may be made to the invention. For example, the base member may be a flat rectangular plate of a desired length and width rather than comprising two separate strips as above described. Furthermore, there is available a wide variety of materials which may be employed in the fabrication including metals, wood and plastic. Similarly, the support members 18 and 20 may be integrally formed "U"-shaped brackets as illustrated or may comprise separate vertical projections which may be secured in a variety of ways to the base member. Accordingly, the true spirit and scope of the invention should be determined from the appended claims.

What is claimed is:

1. A vacuum bottle retainer for holding said bottle in a predetermined position within a vehicle, comprising:

(a) a generally rectangular base member comprising first and second elongated strips disposed in a parallel, coplanar, spaced apart relationship and having a first pair of support members rigidly connected proximate one end thereof and extending upwardly therefrom for a first predetermined distance and a second pair of support members rigidly connected proximate the other end thereof and extending upwardly therefrom for a second predetermined distance greater than said first predetermined distance, said support members each comprising generally "U"-shaped brackets having parallel, spaced apart legs integrally formed with a connecting cross member, said cross member being attached between said first and second elongated strips, said base member further including a median rib extending between and affixed to said cross members of said "U"-shaped brackets;

(b) first and second cradle members disposed between said parallel, spaced apart legs of said first and second pairs of support members, respectively, and shaped to generally conform to the outer peripheral surface of a vacuum bottle;

(c) a first flexible strap secured at one end to said base member at a point intermediate said first and second pairs of support members and of a length sufficient to pass around the outer periphery of said vacuum bottle when said bottle is resting in said first and second cradle members and connect to said base member; and (d) a second flexible strap member having first and second ends thereof adapted to be coupled to opposed ends of said median rib for securing said vacuum bottle retainer to a vehicle seat.

* * * * *